US010808514B2

(12) United States Patent
Lin et al.

(10) Patent No.: US 10,808,514 B2
(45) Date of Patent: Oct. 20, 2020

(54) MULTI-STAGE COMBUSTION IMPACT WAVE COAL MASS CRACKING AND HEAT INJECTION ALTERNATING INTENSIFIED GAS EXTRACTING METHOD

(71) Applicants: China University of Mining and Technology, Jiangsu (CN); XUZHOU BOAN SCIENCE & TECHNOLOGY DEVELOPMENT CO., LTD, Jiangsu (CN)

(72) Inventors: Baiquan Lin, Jiangsu (CN); Yang Zhao, Jiangsu (CN); Wei Yang, Jiangsu (CN)

(73) Assignees: China University of Mining and Technology, Jiangsu (CN); XUZHOU BOAN SCIENCE & TECHNOLOGY DEVELOPMENT CO., LTD, Jiangsu (CN)

( * ) Notice: Subject to any disclaimer, the term of this patent is extended or adjusted under 35 U.S.C. 154(b) by 0 days.

(21) Appl. No.: 16/632,885

(22) PCT Filed: Oct. 29, 2018

(86) PCT No.: PCT/CN2018/112292
§ 371 (c)(1),
(2) Date: Jan. 22, 2020

(87) PCT Pub. No.: WO2019/242190
PCT Pub. Date: Dec. 26, 2019

(65) Prior Publication Data

US 2020/0182033 A1 Jun. 11, 2020

(30) Foreign Application Priority Data

Jun. 22, 2018 (CN) ..... 2018 1 0652404

(51) Int. Cl.
*E21B 43/26* (2006.01)
*E21F 7/00* (2006.01)

(52) U.S. Cl.
CPC ..... *E21B 43/26* (2013.01); *E21F 7/00* (2013.01)

(58) Field of Classification Search
CPC ..... E21B 43/26
(Continued)

(56) References Cited

U.S. PATENT DOCUMENTS 7,770,646 B2 * 8/2010 Klassen ..... E21B 43/164 166/303
2009/0159277 A1 6/2009 Hocking

FOREIGN PATENT DOCUMENTS

CN 104234739 12/2014
CN 104314605 1/2015
(Continued)

OTHER PUBLICATIONS

"International Search Report (Form PCT/ISA/210) of PCT/CN2018/112292", dated Feb. 21, 2019, with English translation thereof, pp. 1-4.

*Primary Examiner* — Angela M DiTrani Leff
*Assistant Examiner* — Ashish K Varma
(74) *Attorney, Agent, or Firm* — JCIPRNET

(57) ABSTRACT

A multi-stage combustion impact wave coal mass cracking and heat injection alternating intensified gas extracting method is provided. A large amount of $N_2$ or $CO_2$ is injected into a drill hole by a heat injection and gas injection extracting pipe and by a high-pressure gas cylinder and a reducing valve, then a certain amount of methane and dry air are injected into a high-temperature and high-pressure combustion chamber by the high-pressure gas cylinder and the reducing valve, to be mixed and combusted to form high-
(Continued)

temperature and high-pressure impact wave. High-temperature vapour is injected into the drill holes by the heat injection and gas injection extracting pipe to promote desorption of the coal masses.

5 Claims, 1 Drawing Sheet

(58) Field of Classification Search
USPC ..... 166/308.2
See application file for complete search history.

(56) References Cited

FOREIGN PATENT DOCUMENTS

| | | | | | |
|---|---|---|---|---|---|
| CN | 104314605 A | * | 1/2015 | ..... | E21B 43/26 |
| CN | 104632270 | | 5/2015 | | |
| CN | 106089171 | | 11/2016 | | |
| RU | 2592910 | | 7/2016 | | |

* cited by examiner

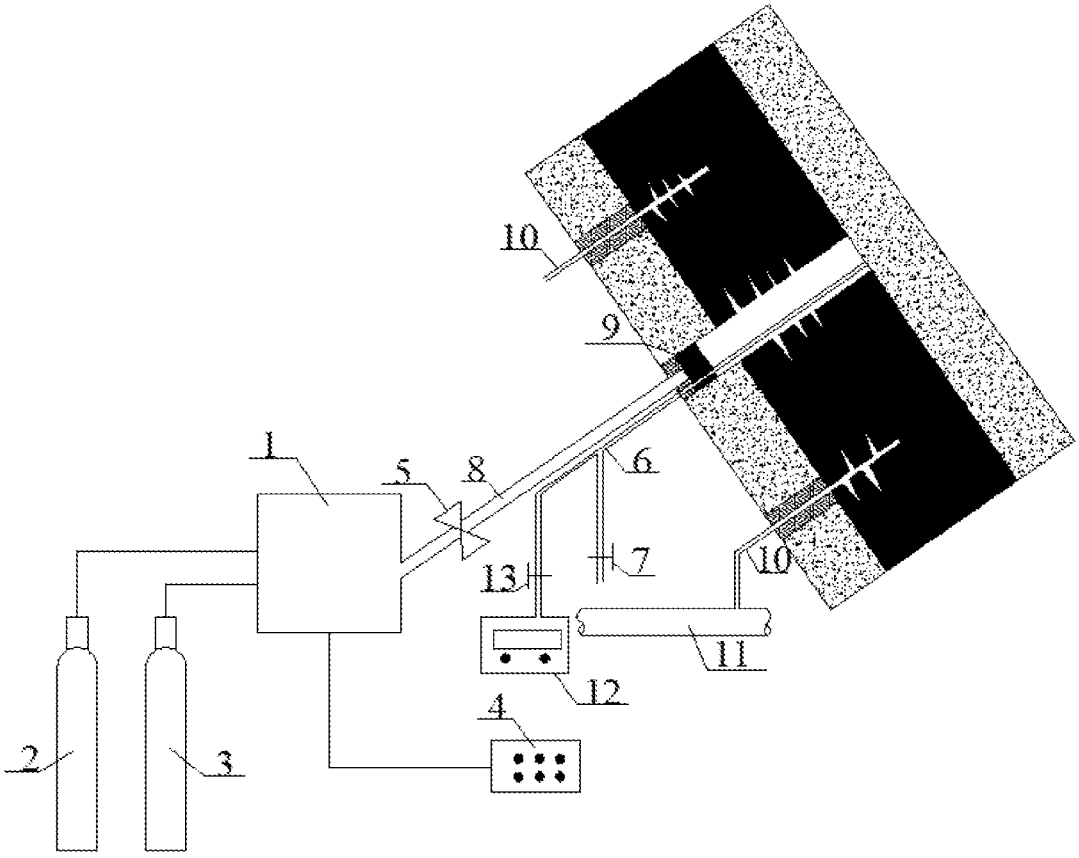
10
9
1
5
8
6
7
13
10
11
12
4
2
3

MULTI-STAGE COMBUSTION IMPACT WAVE COAL MASS CRACKING AND HEAT INJECTION ALTERNATING INTENSIFIED GAS EXTRACTING METHOD

CROSS-REFERENCE TO RELATED APPLICATION

This application is a 371 of international application of PCT application serial no. PCT/CN2018/112292, filed on Oct. 29, 2018, which claims the priority benefit of China application no. 201810652404.7, filed on Jun. 22, 2018. The entirety of each of the above mentioned patent applications is hereby incorporated by reference herein and made a part of this specification.

BACKGROUND

Technical Field

The present invention relates to coal mass cracking and gas extraction, in particular to a multi-stage combustion impact wave coal mass cracking and heat injection alternating intensified gas extracting method.

Description of Related Art

Along with increase of energy demand and mining intensity, coal mining depth is gradually increased. Deep coal seams have the characteristics of high ground stress, high gas pressure, high gas content and low permeability, and the cross coupling effect of all factors causes frequent deep mine disasters. Gas of the coal seams is one of major factors causing deep mine dynamic disaster, the global coalbed methane reserve reaches about 250 trillion cubic meters. Coalbed methane is not only a high-efficiency clean energy, but also a greenhouse gas, the generated greenhouse effect is 25-30 times of that of carbon dioxide, and the coalbed methane has dangers of explosion and outburst. In order to increase the energy utilization rate and reduce the occurrence of mine disaster, increase of the drill hole gas extracting efficiency is very necessary. Drill hole gas extraction is a major means for realizing reclamation of coal mine underground gas, and is also an important means for preventing gas disaster. In order to increase the drill hole extracting efficiency of the coal seams, and reduce the dangers of gas explosion and outburst, it is very necessary to design and develop a coal mass cracking and intensified gas extracting method high in safety, low in cost and easy to operate.

Most coal seams in China are characterized of having low-permeability, especially when mining is performed at a deep position, the air permeability of the coal seams is poor. Therefore, the influence scope of common drill hole extraction is limited, pressure relief is low, drill hole flow is small and attenuation coefficient is large. In order to increase the extracting efficiency of the coal seam gas, pressure relief anti-reflection needs to be performed on the coal seams to increase the influence scope of the drill hole extraction. The current coal mass pressure relief anti-reflection technology mainly includes a deep hole blasting technology. However, the deep hole blasting technology has certain dangers, and may cause accidents by misoperation because underground conditions are relatively complicated and changeable, especially the deep holes internal conditions.

SUMMARY

Aiming at the deficiencies in the prior art that the influence scope of drill hole extraction is limited, pressure relief is low, drill hole flow is small, attenuation coefficient is great, risk is high, operation is complicated and the like, the present invention provides a coal mine underground multi-stage combustion impact wave coal mass cracking intensified gas extracting method high in safety, low in cost and easy to operate.

A specific technical scheme of the present invention is as follows:

A multi-stage combustion impact wave coal mass cracking and heat injection alternating intensified gas extracting method includes following steps:

S1: an impacting and heat injecting drill hole is constructed in a coal seam;

S2: a porous cylinder with a piston is put in the impacting and heat injecting drill hole, one end of a heat injection and gas injection extracting pipe is penetrated through the piston to be put into the porous cylinder, the other end of the heat injection and gas injection extracting pipe is extended out of the impacting and heat injecting drill hole, and the other end of the heat injection and gas injection extracting pipe is connected with a gas injection pipe and a heat injection pipe by a tee joint; one end of an impact wave ingress pipe is put into the porous cylinder, and the other end of the impact wave ingress pipe is connected to a combustion chamber outside the impacting and heat injecting drill hole, wherein the impact wave ingress pipe does not penetrate through the piston;

S3: the impacting and heat injecting drill hole is sealed, the heat injection pipe is closed, the gas injection pipe is opened, $N_2$ or $CO_2$ is injected into the impacting and heat injecting drill hole by the heat injection and gas injection extracting pipe, and then the gas injection pipe is closed;

S4: combustible gas and auxiliary gas are injected into the combustion chamber;

S5: the combustible gas in the combustion chamber is ignited by a control system, wherein impact wave generated by combustion of the combustible gas is guided into the porous cylinder by the impact wave ingress pipe to impact the piston, and the piston slides along the heat injection and gas injection extracting pipe to extrude $N_2$ or $CO_2$ in the impacting and heat injecting drill hole, so that coal masses at a periphery of the impacting and heat injecting drill hole generate a large quantity of cracks;

S6: the gas injection pipe is closed, the heat injection pipe is opened to inject high-temperature vapour into the impacting and heat injecting drill hole by the heat injection and gas injection extracting pipe, and the heat injection pipe is closed after injection of the high-temperature vapour lasts for 2-3 hours; and S7: the heat injection and gas injection extracting pipe is connected into an extracting system to perform gas extraction after temperature in the impacting and heat injecting drill hole is reduced.

Further, after step S7, the method further includes following steps:

S8: when concentration of gas extracted by the extracting system is reduced to 25% or lower, the heat injection and gas injection extracting pipe is withdrawn from the extracting system, the gas injection pipe is opened, a large amount of $N_2$ is continuously injected into the drill hole by the heat injection and gas injection extracting pipe to extrude the piston so as to reset the piston, and then the gas injection pipe is closed; and S9: steps S4-S8 are repeated, and gas extraction by synergistic effect of the multi-stage combustion impact wave coal mass cracking and heat injection alternating is intensified.

Further, step S1 specifically includes that the impacting and heat injecting drill hole and a common drill hole are constructed in the coal seam, wherein the common drill hole is located at the periphery of the impacting and heat injecting drill hole. Step S2 specifically includes that the porous cylinder with the piston is put in the impacting and heat injecting drill hole, the one end of the heat injection and gas injection extracting pipe is penetrated through the piston to be put into the porous cylinder, the other end of the heat injection and gas injection extracting pipe is extended out of the impacting and heat injecting drill hole, and the other end of the heat injection and gas injection extracting pipe is connected with the gas injection pipe and the heat injection pipe by the tee joint; one end of the impact wave ingress pipe is put into the porous cylinder, and the other end of the impact wave ingress pipe is connected to the combustion chamber outside the impacting and heat injecting drill hole, wherein the impact wave ingress pipe does not penetrate through the piston; one end of a common extracting pipe is put into the common drill hole and the hole is sealed, and the other end of the common extracting pipe is connected to the extracting system.

Further, a solenoid valve is also provided on the impact wave ingress pipe, and the solenoid valve is set and regulated by the control system.

Further, an opening pressure value of the solenoid valve is 30 MPa.

Further, the combustible gas is methane, and the auxiliary gas is dry air.

Compared with the prior art, the present invention has the following beneficial effects. By adopting the multi-stage combustion impact wave coal mass cracking and heat injection alternating intensified gas extracting method, high-temperature and high-pressure impact wave generated by mixed combustion of the methane and the dry air in the high-temperature and high-pressure combustion chamber impacts the piston in multiple stages to extrude $N_2$ or $CO_2$, so that a large quantity of cracks are generated at the periphery of the drill hole; by performing multi-stage impacting compressing and cracking on coal masses at the periphery of the impacting and heat injecting drill hole, the original crack aperture is enlarged, the connectivity of the crack networks in the coal masses is intensified, and the pressure relief scope of the extracting drill hole is remarkably extended. After the high-temperature and high-pressure impact wave impacts the piston, residual high-temperature and high-pressure impact wave also promotes desorption and flow of the gas of the coal seam, so as to better promote the gas extracting efficiency of the drill hole; high-temperature vapour is injected into the drill hole to further promote the desorption and flow of the coal masses; and the method is high in safety, low in cost, and easy to operate, and meanwhile is applicable to pressure relief anti-reflection and desorption and flow of the gas of coal mine underground crossing drill hole and bedding drill hole, and is wide in application scope.

BRIEF DESCRIPTION OF THE DRAWINGS

FIG. 1 is a schematic diagram of an equipment structure used by a multi-stage combustion impact wave coal mass cracking and heat injection alternating intensified gas extracting method in embodiment 1 of the present invention and a mounting position thereof.

DESCRIPTION OF THE EMBODIMENTS

Further descriptions of the present invention are made in the following by referring to the accompanying drawings.

Embodiment 1

As shown in FIG. 1, coal mine underground multi-stage combustion impact wave coal mass cracking and intensified gas extracting equipment includes a porous cylinder 9 with a piston, a heat injection and gas injection extracting pipe 6, an impact wave ingress pipe 8, a combustion impacting device, a vapour generating device 12 and an extracting system 11.

One end of the heat injection and gas injection extracting pipe 6 penetrates through the piston in the porous cylinder 9 and extends into the porous cylinder 9, and the piston slides on the heat injection and gas injection extracting pipe 6. The other end of the heat injection and gas injection extracting pipe 6 extends out of the porous cylinder 9 and is connected with a gas injection pipe and a heat injection pipe by a tee joint. A first valve 7 is mounted on the gas injection pipe, a second valve 13 is mounted on the heat injection pipe, the gas injection pipe is connected with an $N_2$ cylinder, and the heat injection pipe is connected with the vapour generating device 12. One end of the impact wave ingress pipe 8 is connected with the combustion impacting device, and the other end of the impact wave ingress pipe extends into the porous cylinder and does not penetrate through the piston. A common extracting pipe 10 is connected with the extracting system 11.

The combustion impacting device includes a high-temperature and high-pressure combustion chamber 1, a first gas injection pipe, a second gas injection pipe and a control system 4. One end of the first gas injection pipe and one end of the second gas injection pipe are respectively connected with the high-temperature and high-pressure combustion chamber 1, and the other end of the first gas injection pipe and the other end of the second gas injection pipe are respectively connected with a methane cylinder 3 and a dry air cylinder 2. An ignition device of the control system 4 extends into the combustion chamber, the first gas injection pipe is used for injecting methane into the high-temperature and high-pressure combustion chamber 1, the second gas injection pipe is used for injecting dry air into the high-temperature and high-pressure combustion chamber 1, and the control system 4 is used for igniting methane in the high-temperature and high-pressure combustion chamber 1. The solenoid valve 5 is mounted on the impact wave ingress pipe 8, and is controlled by the control system 4.

Embodiment 2

The coal mine underground multi-stage combustion impact wave coal mass cracking and intensified gas extracting method 1 is performed by using the equipment in embodiment 1, wherein the method specifically includes following steps.

a. A common drill hole and an impacting and heat injecting drill hole are alternately constructed in a coal seam, wherein the common drill hole is located at a periphery of the impacting and heat injecting drill hole.

b. After construction is completed, a porous cylinder 9 with a piston is put in the impacting and heat injecting drill hole, wherein the cylinder wall of the porous cylinder 9 is tightly adhered to the impacting and heat injecting drill hole.

c. A heat injection and gas injection extracting pipe 6 is put in the porous cylinder 9, then the heat injection and gas injection extracting pipe 6 and the porous cylinder 9 are placed in the impacting and heat injecting drill hole together, an impact wave ingress pipe 8 is tightly connected with the piston, and then hole sealing operation is performed; after the hole sealing operation is completed, a common extracting pipe 10 is connected to an extracting system 11 to extract gas; and then an opening pressure value of a solenoid valve 5 is set as 30 MPa by the control system 4.

d. A second valve 13 is closed, a first valve 7 is opened, a large amount of $N_2$ or $CO_2$ is injected into the impacting and heat injecting drill hole via the heat injection and gas injection extracting pipe 6 by a gas injection pipe by using a high pressure gas cylinder and a reducing valve, and then the first valve 7 is closed.

e. A certain amount of dry air and methane is injected into the high-temperature and high-pressure combustion chamber 1 by a methane cylinder 3, a dry air cylinder 2 and the reducing valve, and the mixed gas is ignited by the control system 4.

f. After the pressure in the high-temperature and high-pressure combustion chamber 1 reaches 30 MPa, the high-temperature and high-pressure impact wave is instantly released by the automatic start of the solenoid valve 5, and the piston is impacted by the impact wave ingress pipe 8, wherein the piston slides along the heat injection and gas injection extracting pipe 6 to extrude $N_2$ or $CO_2$, and further a large quantity of cracks are generated at the periphery of the impacting and heat injecting drill hole, and the connectivity of the crack network is intensified.

g. A vapour generating device 12 is started, the second valve 13 is opened, high-temperature vapour of 150° C.-250° C. is injected into the impacting and heat injecting drill hole via the heat injection and gas injection extracting pipe 6 by the heat injection pipe to promote the desorption of gas in the coal mass, and the second valve 13 is closed after heat injection lasts for 2-3 hours.

h. After temperature in the impacting and heat injecting drill hole is reduced, the gas injection pipe is connected into the extracting system 11, and the first valve 7 is opened to perform gas extraction.

i. When the concentration of the gas extracted by the extracting system 11 is reduced to 25% or lower, the first valve 7 is closed, and the gas injection pipe is withdrawn from the extracting system 11; then the first valve 7 is opened, a large amount of $N_2$ or $CO_2$ is continuously injected into the impacting and heat injecting drill hole via the heat injection and gas injection extracting pipe 6 by the gas injection pipe to extrude the piston, to reset the piston, and then the first valve 7 is closed.

j. Steps e-i are repeated, and drill hole gas extraction is intensified by the synergistic effect of combustion impact wave coal mass cracking and heat injection alternating.

What is claimed is:

1. A multi-stage combustion impact wave coal mass cracking and heat injection alternating intensified gas extracting method, the method comprising following steps in sequence:

step 1: constructing an impacting and heat injecting drill hole in a coal seam;

step 2: placing a porous cylinder with a piston in the impacting and heat injecting drill hole, penetrating one end of a heat injection and gas injection extracting pipe through the piston to be put into the porous cylinder, extending the other end of the heat injection and gas injection extracting pipe out of the impacting and heat injecting drill hole, and connecting the other end of the heat injection and gas injection extracting pipe with a gas injection pipe and a heat injection pipe by a tee joint; putting one end of an impact wave ingress pipe into the porous cylinder, and connecting the other end of the impact wave ingress pipe to a combustion chamber outside the impacting and heat injecting drill hole, wherein the impact wave ingress pipe does not penetrate through the piston;

step 3: sealing the impacting and heat injecting drill hole, closing the heat injection pipe, opening the gas injection pipe, injecting $N_2$ or $CO_2$ into the impacting and heat injecting drill hole by the heat injection and gas injection extracting pipe, and then closing the gas injection pipe;

step 4: injecting combustible gas and auxiliary gas into the combustion chamber;

step 5: igniting the combustible gas in the combustion chamber by a control system, wherein impact wave generated by combustion of the combustible gas is guided into the porous cylinder by the impact wave ingress pipe to impact the piston, and the piston slides along the heat injection and gas injection extracting pipe to extrude $N_2$ or $CO_2$ in the impacting and heat injecting drill hole, so that coal masses at a periphery of the impacting and heat injecting drill hole generate a large quantity of cracks;

step 6: closing the gas injection pipe, opening the heat injection pipe to inject high-temperature vapour of 150° C.-250° C. into the impacting and heat injecting drill hole by the heat injection and gas injection extracting pipe, and closing the heat injection pipe after injection of the high-temperature vapour lasts for 2-3 hours;

step 7: connecting the heat injection and gas injection extracting pipe into an extracting system to perform gas extraction after temperature in the impacting and heat injecting drill hole is reduced;

step 8: when concentration of gas extracted by the extracting system is reduced to 25% or lower, withdrawing the heat injection and gas injection extracting pipe from the extracting system, opening the gas injection pipe, continuously injecting a large amount of $N_2$ into the impacting and heat injecting drill hole by the heat injection and gas injection extracting pipe to extrude the piston so as to reset the piston, and then closing the gas injection pipe; and step 9: repeating the steps 4-8, and intensifying the gas extraction by synergistic effect of the multi-stage combustion impact wave coal mass cracking and heat injection alternating.

2. The multi-stage combustion impact wave coal mass cracking and heat injection alternating intensified gas extracting method according to claim 1, wherein step 1 further comprises constructing the impacting and heat injecting drill hole and a common drill hole in the coal seam, wherein the common drill hole is located at the periphery of the impacting and heat injecting drill hole; and step 2 further comprises placing the porous cylinder with the piston in the impacting and heat injecting drill hole, penetrating the one end of the heat injection and gas injection extracting pipe through the piston to be put into the porous cylinder, extending the other end of the heat injection and gas injection extracting pipe out of the impacting and heat injecting drill hole, and connecting the other end of the heat injection and gas injection extracting pipe with the gas injection pipe and the heat injection pipe by the tee joint; putting one end of the impact wave ingress pipe into the porous cylinder, and connecting the other end of the impact wave ingress pipe to the combustion chamber outside the impacting and heat injecting drill hole, wherein the impact wave ingress pipe does not penetrate through the piston; putting one end of a common extracting pipe into the common drill hole and sealing the hole, and connecting the other end of the common extracting pipe to the extracting system.

3. The multi-stage combustion impact wave coal mass cracking and heat injection alternating intensified gas extracting method according to claim 1, wherein a solenoid valve is further provided on the impact wave ingress pipe, and the solenoid valve is set and regulated by the control system.

4. The multi-stage combustion impact wave coal mass cracking and heat injection alternating intensified gas extracting method according to claim 3, wherein an opening pressure value of the solenoid valve is 30 MPa.

5. The multi-stage combustion impact wave coal mass cracking and heat injection alternating intensified gas extracting method according to claim 1, wherein the combustible gas is methane, and the auxiliary gas is dry air.

* * * * *